US006677954B1

(12) United States Patent
Jensen et al.

(10) Patent No.: US 6,677,954 B1
(45) Date of Patent: Jan. 13, 2004

(54) GRAPHICS REQUEST BUFFER CACHING METHOD

(75) Inventors: Allen Jensen, Austin, TX (US); Dale Kirkland, Madison, AL (US); Harald Smit, Austin, TX (US)

(73) Assignee: 3Dlabs, Inc., Ltd, Hamilton (BM)

( * ) Notice: Subject to any disclaimer, the term of this patent is extended or adjusted under 35 U.S.C. 154(b) by 201 days.

(21) Appl. No.: 10/010,469

(22) Filed: Nov. 8, 2001

Related U.S. Application Data

(60) Provisional application No. 60/255,673, filed on Dec. 14, 2000.

(51) Int. Cl.[7] ..... G09G 5/39

(52) U.S. Cl. ..... 345/531; 345/536

(58) Field of Search ..... 345/530, 531, 345/536, 501, 557–560; 711/118, 154, 100

(56) References Cited

U.S. PATENT DOCUMENTS

| | | | | |
|---|---|---|---|---|
| 5,959,639 A | | 9/1999 | Wada | 345/520 |
| 6,339,427 B1 | * | 1/2002 | Laksono et al. | 345/553 |
| 6,353,874 B1 | * | 3/2002 | Morein | 711/118 |
| 6,438,665 B2 | * | 8/2002 | Norman | 711/159 |

* cited by examiner

*Primary Examiner*—Kee M. Tung
(74) *Attorney, Agent, or Firm*—Arnall Golden Gregory LLP

(57) ABSTRACT

A method for caching graphics-related data in one or more graphics request buffers wherein duplicative graphics-related data is not written to the graphics request buffers. In the preferred method the graphics-related data is sent in frames, and each frame contains frame setup data and graphical model data, and the model data is compared between the stored frame and the new frame to determine if there is new model data to be written to the graphics request buffers.

15 Claims, 2 Drawing Sheets

GRAPHICS REQUEST BUFFER CACHING METHOD

CROSS-REFERENCE TO RELATED APPLICATION

This application claims the benefit of U.S. Provisional Application Ser. No. 60/255,673, filed Dec. 14, 2000.

BACKGROUND OF THE INVENTION

1. Field of the Invention

The present invention generally relates to computer systems. More particularly, the present invention relates to computer graphic processing hardware and methods of caching data in the graphics request buffer(s) where the graphics request buffers contain commands that direct the graphics hardware processing.

2. Description of the Related Art

Modem computer platforms often have one or more separate graphic hardware platforms, commonly called a "graphics card," which have associated application-specific hardware and software for graphics data processing. The graphics hardware common in the industry include one or more data buffers, referred to as "request buffers," that receive graphics data from one or more host processors, and are processed by the graphics hardware. Request buffers can reside in either host memory or memory on the graphics hardware. The graphics hardware can access the ml request buffers with a direct memory access (DMA) mechanism for very fast throughput.

In a 3-dimensional (3D) graphics environment, the need for graphics data throughput is particularly acute due to the significant amount of data contained in the complex 3D graphics. The graphics hardware requests occur from graphic processing calls made by the application executing on the host CPU, typically from graphics application programming interfaces (APIs), such as OpenGL or Direct3D.

A plurality of request buffers are often used so that while one request buffer is being written with data by the host, the data in the previous request buffer is being sent to the graphics hardware for processing, possibly through a DMA channel. The use of the plurality of request buffers thus improves performance in allowing overlap between the host writing to one request buffer and the graphics adapter processing graphics data from another request buffer.

In some host CPU architectures, a mechanism called write-combining accelerates writes to the graphics hardware. Accordingly, allocating the request buffer in memory in the graphics hardware and using the write-combining mechanism can give extremely good graphics data writing performance. As the graphics data from the host is written into memory on the graphics hardware, no additional host bus transfers of the graphics data are required to process the graphics data held in the request buffer(s).

Graphics hardware that does not have local memory for the graphics CPU can still utilize write-combining to speed graphics data processing. The request buffers are allocated in host memory as non-cacheable. Write-combining transfers to the non-cached request buffers still produce good write performance, and since the buffers are non-cacheable, DMA transfers can be used to move the data to the graphics hardware, such as AGP 4× DMA transfers. Because the AGP 4× DMA transfers are not snooped by the host CPU cache, the graphics data must be guaranteed to be in memory by using either non-cached memory or by cache flushing.

However, write-combining does not accelerate reads of the request buffer. Even so, the reads of the request buffer(s) are not performance critical since the vast amount of graphics data being moved is from the host CPU to the graphics hardware.

There have been changes in industry-common host CPU architectures, such as the Pentium IV from Intel, which require alteration to the approach of constructing request buffers using write-combining, irrespective of whether the request buffer(s) is located in the graphics hardware memory or host memory. A particular characteristic of the modern CPU architecture is to send small bursts of graphics-related data to the graphics hardware for processing. As write-combining only works well if large bursts of data are sent across the graphics hardware bus or host bus, the small bursts of graphics data sent from the modem CPU can greatly reduce the performance of graphics related data moves using write-combining. Write-combining therefore becomes a less efficient data movement mechanism to supply the graphics related data to the graphics hardware for processing.

It would therefore be advantageous to provide a method for caching graphics-related data in the graphics request buffer(s) whereby the data is not flushed to the host memory if it is duplicative of graphics related data already stored. Furthermore, such method should account for changes in modem host CPU architectures wherein short bursts of graphics related data are commonly sent from the host CPU to the graphics hardware. It is accordingly to the provision of such a methodology for caching graphics-related data in the graphics requests buffer(s) that the present invention is primarily directed.

SUMMARY OF THE INVENTION

Briefly described, the present invention is a method for caching graphics-related data in one or more graphics request buffers wherein duplicative graphics-related data is not written to the graphics request buffers. The method for caching graphics-related data into a least one of a plurality of graphics request buffers includes the steps of initializing a flush start pointer in one of the plurality of graphics requests buffers prior to the receipt of any graphics-related data at the request buffer(s), then receiving a graphics-related data at the one of the plurality of graphics request buffers. The graphics related data is preferably a frame comprised of setup data and model data, and the entire frame is held within the plurality of graphics request buffers.

The method further includes the steps of repositioning the flush start pointer to the beginning memory location in the plurality of graphics request buffers where the incoming frame will be written. The location of the pointer can be handled either locally at the request buffer or through the graphics CPU, or managed through a combination of the request buffer and graphics CPU. Then the graphics related data, such as the frame, is written to the memory location referenced by the flush start pointer, and upon the request buffer(s) receiving an additional frame of graphics-related data, a determination is made as to whether model data is present in the additional frame. If model data is present in the additional frame, the method includes the step of flushing the stored frame from the plurality of graphics buffers for processing, and if model data is not present in the additional frame, then the method includes the step of writing the additional frame to the plurality of graphics request buffers.

If the model data was flushed from the plurality of request buffers, the model data from the additional frame (or graphics related data) is compared with the flushed model data from the stored frame, and if the model data from the additional frame does not match the flushed model data, the additional frame is written to the plurality of graphics request buffers. Otherwise, if the model data from the additional frame matches the flushed model data, the method includes the step of receiving, but not writing, the entire frame or graphics related data sequence. Finally, the flush start pointer is incremented to a new memory location where further graphics related data, such as an additional frame, would be written if received containing new data.

In the preferred method, the graphics-related data is sent in frames and each frame contains frame setup data and graphical model data. The model data is compared between the stored frame and the new frame to determine if there is new model data to be written to the graphics request buffers. Further, a plurality of reference pointers can be used such that this method includes the steps of writing the frame to the memory location referenced by the flush start pointer, referencing a second pointer to a memory location in one of the plurality of graphics requests buffers prior to the receipt of any additional graphics-related data (such as a frame). In such an embodiment, the step of writing the additional frame to the plurality of graphics request buffers is writing the additional frame to the memory location in the plurality of request buffers referenced by the second pointer.

The step of comparing the model data from the additional frame with the flushed model data from the stored frame is preferably comparing the model data from the additional frame with the flushed model data from the stored frame and ceasing the comparison upon locating a substantial non-matching data set within the model data from the additional frame. One preferable manner to determine if model data is present in the additional frame with the stored graphics related data is to determine if the size of the additional frame is the same as the size of the stored frame. Furthermore, the step of flushing the stored frame from the plurality of graphics buffers for processing is preferably by use of DMA to the graphics hardware.

The present inventive methodology further provides for additional data optimization as part of the graphics related data has been determined to be static. Further analysis on the static data can reveal optimal methods for request buffer management, such as altering the data organization, one example being lossless data reduction of static elements. Static graphics-related data could also be cached within the graphics hardware memory to enhance throughput with the repeated processing of the common graphics-related data.

The present invention therefore provides a graphics related data processing methodology through the caching of the graphics related data in one or more request buffers wherein the graphics processing throughout is greatly enhanced due to the elimination of duplicative data being held in the request buffers. The present invention can be utilized in modern CPU architectures that provide small bursts of graphics-related data from the host CPU to the graphics hardware, as the plurality of cached request buffers can sort through the increased amount of incoming graphics-related data. Because existing graphics hardware includes one or more request buffers, the present methodology can be implemented as a data management tool on existing request buffer architectures, without the need for additional hardware controls. Moreover, existing request buffers can also have hardware modification to better support the caching method if so desired.

Other objects, features, and advantages of the present invention will become apparent after review of the hereinafter set forth Brief Description of the Drawings, Detailed Description of the Invention and the Claims.

DETAILED DESCRIPTION OF THE INVENTION

Figure 1:
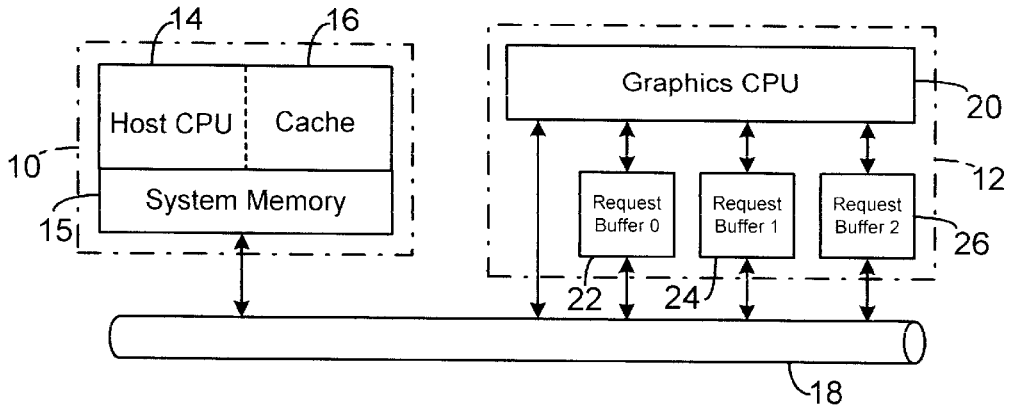
FIG. 1 is a block diagram illustrating the host CPU and cache in communication with the Graphics CPU and request buffers across a system bus.

With reference to the figures in which like numerals represent like elements throughout, FIG. 1 is a block diagram illustrating a generic computer system having a host platform 10 in communication with a graphics hardware platform 12 across a system bus 18. The host platform 10 includes a host central processing unit (CPU) 14, the host CPU system memory 15, and cache 16 associated therewith. The graphics-related data is processed at the host CPU 14 and may or may not be held in the host memory 15 depending upon the particular configuration of the host architecture and memory processing occurring at the time of the generation of graphics-related data. Graphics-related data is generated on the host platform 10 from the execution of a graphics program, such as is common in games, CAD, and multimedia applications. Once the graphics related data is generated and held either at system memory 15 or within the host CPU 14, the graphics related data is sent to the graphics hardware platform 12 across the system bus 18. The system bus 18 shown here is merely exemplary of a communication protocol between the host platform 10 and graphics hardware platform 12, and other methods of transferring data between computer platforms as are known in the art can be used in the present invention to interconnect the host platform 10 and graphics hardware platform 12.

The graphics platform 12 includes, inter alia, a graphics CPU 20 that performs the graphics-related data processing and generates graphics output to a display or back to the host CPU 14. The graphics platform 12 includes one or more request buffers, shown here as a plurality of three request buffers, 22,24,26. The request buffers 22,24,26 are serially implemented in FIG. 1 so that as the data arrives, it is cached in request buffer 0 (22), then request buffer 1 (24), and then request buffer 2 (26). In such manner, a non-trivial amount of graphics related data can be stored in the request buffers and serially sent from the request buffers 22,24,26 to the graphics CPU 20 for processing.

The present invention provides a processing advantage especially where large amounts of duplicative graphics data is generated in the host CPU 14 and is sent to the graphics hardware platform 12. For example, many 3D graphics applications constantly generate almost the exact same model data for processing at the graphics hardware, such as CAD application spinning a mechanical model which only changes the matrix that is used to project the model onto the display and not the underlying data, and such graphics data is held in the request buffers 22,24,26 for each frame that is drawn even though the model data in the frames is redundant.

Figure 2:
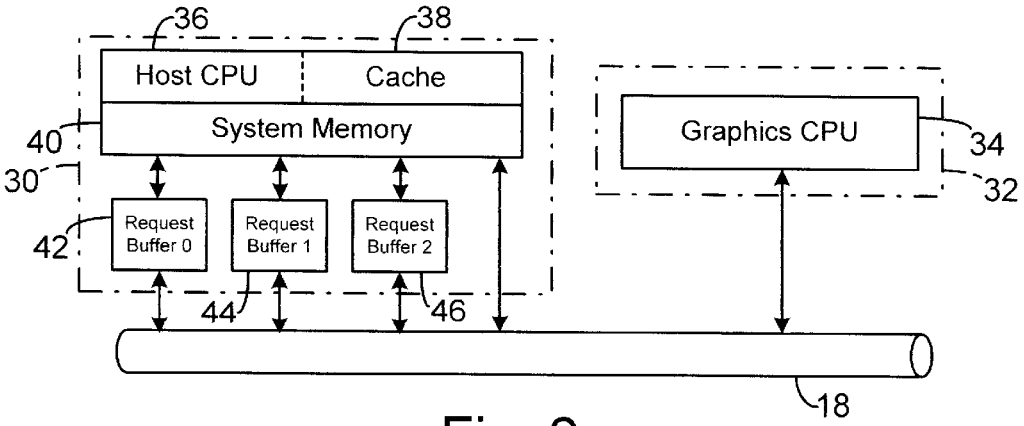
FIG. 2 is a block diagram illustrating another embodiment of the system with the graphics request buffers resident on the host CPU platform and in communication with the graphics platform and CPU across the system bus.

An alternate embodiment of the graphics request buffers 42,44,46 is shown in FIG. 2 as resident on the host platform 40, which is in communication with a common graphics hardware platform 32 across a system bus 18. In this embodiment, the graphics platform 32 has a standard graphics CPU 34 that may or may not have a data buffer. The host platform 40 includes a host CPU 36, the host CPU cache 38 and system memory 40 associated therewith. The graphics-related data is processed at the host CPU 36 and may or may not be held in the system memory 40. Once the graphics related data is generated and held either at system memory 40 or within the host CPU 36, the graphics related data is sent to the graphics request buffers 42,44,46 before transmission to graphics hardware platform 32 across the system bus 18. In the same manner as request buffers 22,24,26, request buffers 42,44,46 are serially implemented so that as the data arrives, it is cached in request buffer 0 (42), then request buffer 1 (44), and then request buffer 2 (46). In such manner, a non-trivial amount of graphics related data can be stored in the request buffers 42,44,46 and serially sent therefrom across system bus 18 to the graphics platform 32 and to graphics CPU 34 for processing.

Figure 3:
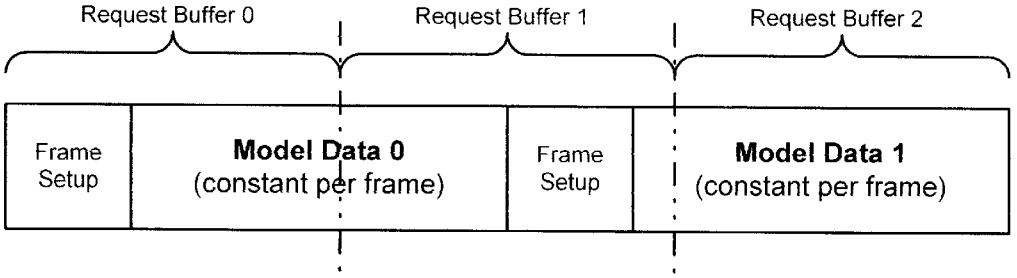
FIG. 3 is a pictorial illustration of the plurality of request buffers holding frames of graphics-related data.

As shown in FIG. 3, a series of duplicate frames of graphics-related data can be generated and sent from the graphics platform 10, and the series of request buffers 22,24,26 or 42,44,46 hold the several frames of data. The frame setup data and model data 0 is held in Request Buffer 0 (22,42) and Request Buffer 1 (24,44) and the second frame with frame setup data and model data 1 is held in Request Buffer 1 (24,44) and Request Buffer 2 (26,46). Thus, two frames are held in a series of three buffers and with the present inventive caching method, the redundant data in the second frame including model data 1 would not have been written to the request buffer(s). It should be noted that the serialized request buffer organization of the host platform 30 or the graphics hardware platform 12 is only one manner of graphics related data handling that is known in the art. The present invention can alternately be applied, for example, in a segmented series of request buffers wherein the frame setup data is stored in one set of request buffers and the potentially constant model data is stored in another set of request buffers. Thus, in order to not overwrite the graphics related data, the sum of all space in the request buffers should be sufficient to hold at least an entire frame size. Multiple request buffers are commonly used to allow overlap between the host filling (or comparing) a request buffer while the graphics CPU 20 is processing the data from the previous request buffer.

The present invention can thus be implemented as a replacement mechanism for data movement within the host platform 10,40 and graphics platform 12,32 in existing architectures. The graphics related data can be transferred from the request buffers as DMA transfers to get the data to the graphics CPU 20,34, such as with AGP 4×. In such configuration, the graphics CPU 20,34 cache must be flushed to memory before the DMA is started since the AGP 4× DMA transfer does not snoop the CPU cache. This can be accomplished with a cache-line flush instruction available on a number of different general purpose CPUs. For example, the Pentium IV architecture includes a CLFLUSH instruction that has the required functionality.

Figure 4:
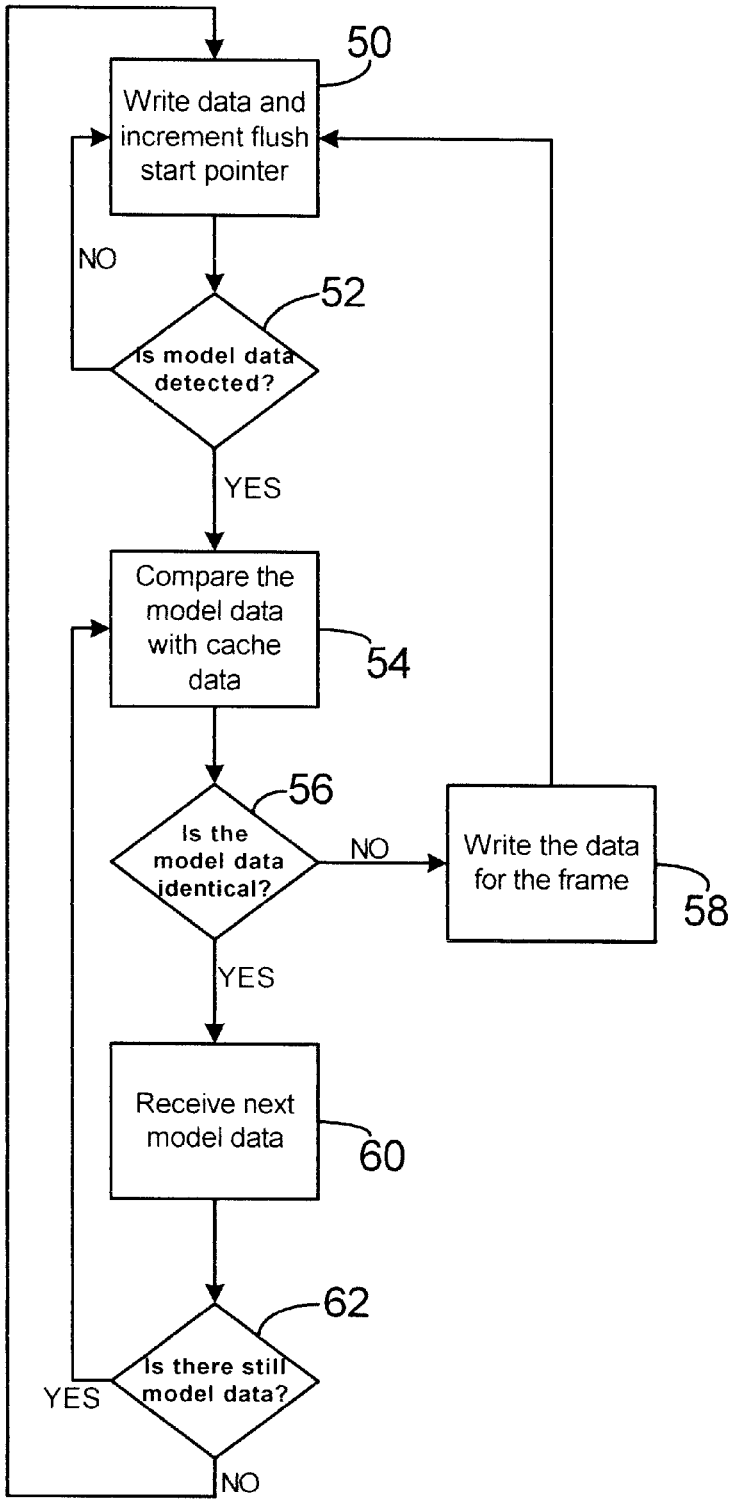
FIG. 4 is a flowchart illustrating the caching method used to prevent duplicate copying of identical model data from the request buffer cache to the graphics CPU.

With reference to FIG. 4, there is shown a flowchart illustrating an embodiment of present inventive caching methodology wherein the method begins at the first receipt of graphics related data such as a frame, which is written to the request buffers 22,24,26 or 42,44,46 and the flush start pointer is incremented to the end of the graphics data, i.e. at the end of the frame, as shown at step 50. In other words, a flush start pointer is initialized to the beginning of the request buffer, and upon receiving the first element of model data or other graphics related data, the request buffer is flushed from the flush start indicator to the current location in the request buffer that is about to be written. This allows handling of the setup data in the request buffer that is changing from frame to frame. As will be seen herein, at the receipt of new model data that is identical to the previous frame model data, the flush start pointer is incremented, but no flushing of data is performed since nothing is being written.

After receipt of graphics related data, a comparison is made upon the receipt of additional graphics related data, such as an additional frame, to determine if any model data is detected, as shown at comparison 52. For a given a set of request buffers which encompass at least one frame data, the beginning of any data which changes frame to frame is recorded with a flush start pointer (this is normally the beginning of the first buffer in the set). When model data is detected in the graphics-related data stream, the data starting from the flush start pointer to typically a current memory reference pointer is flushed from host cache to main memory. If there is no model data present at comparison 52, the data is written to the request buffers 22,24,26 or 42,44,46 and the flush start pointer is incremented, if necessary to mark the addition of the new data. If at comparison 52 model data is detected, then the model data of the stored graphics-related data is compared with the model data of the incoming graphics related data, as shown at step 54, to determine if the incoming model data is redundant of the stored model data, as shown at comparison 56.

If the incoming model data is not identical at comparison 56, then the graphics-related data, such as a frame, is written to the request buffers 22,24,26 or 42,44,46 as shown at step 58, and the process increments the flush start pointer and awaits the receipt of farther graphics related information, or here shown as returning to step 50. If at comparison 56 the incoming model data is identical to the stored data, then the model data is received, but not written, as shown at step 60, which prevents the writing of the redundant model data to the request buffers and thus, prevents the redundant data from going to the graphics CPU 20 and usurping system resources. The incoming model data is then monitored to determine if additional model data is contained in the graphics-related data, as shown at comparison 62, and if there is still model data present, the further model data is again compared with the cached model data (step 54) to ensure that redundant model data is not written. If all incoming model data has been compared at step 62, then the process returns to step 50, writing all non-redundant data identified by the comparison process at comparison 56, and then incrementing the flush start pointer and awaiting more graphics related data.

It can thus be seen that the present invention provides a method for caching graphics-related data in a plurality of graphics request buffers 22,24,26 or 42,44,46 with the steps of initializing a flush start pointer in one of the plurality of graphics requests buffers 22,24,26 prior to the receipt of any graphics-related data, as shown at step 50, and then receiving graphics-related data, such as a frame as shown in FIG. 2, at the one of the plurality of graphics request buffer 22,24,26 or 42,44,46, wherein the frame is preferably comprised of setup data and model data, and the frame being held within the plurality of graphics request buffers 22,24,26 or 42,44,46 as is shown in FIG. 2. Then the method includes the steps of repositioning the flush start pointer to the beginning memory location in the plurality of graphics request buffers where the frame will be written and then writing the frame to the memory location referenced by the flush start pointer. Upon receiving an additional frame of graphics-related data, determined at comparison 52, determining if model data is present in the additional frame with the stored graphics related data, as shown at comparison 56.

If model data is present in the additional frame, the stored frame is flushed from the plurality of graphics buffers 22,24,26 or 42,44,46 to main memory of the graphics CPU 20 such that it can be compared or otherwise processed. If model data is not present in the additional frame, the additional frame is written to the plurality of graphics request buffers 22,24,26 or 42,44,46. If the model data was flushed from the plurality of graphics request data buffers, a comparison is made of the model data from the additional frame with the flushed model data from the stored frame, as shown at step 56, if the model data from the additional frame does not match the flushed model data, the additional frame is written to the plurality of graphics request buffers 22,24, 26 or 42,44,46, as shown at step 58. Thus, if a difference is detected between the incoming model data and the data in cache, the detection mode is exited, and the request buffers are flushed entirely as if the frame size was different frame to frame. Otherwise, if the model data from the additional frame matches the flushed model data, the graphics platform 12 receives, but does not write, the entire frame, and then increments the flush start pointer (step 50) to the new memory location where an additional frame will be written if received containing new model data.

The method can further include the step of, after writing the frame to the memory location referenced by the flush start pointer, referencing a second pointer to a memory location in one of the plurality of graphics requests buffers 22,24,26 or 42,44,46 prior to the receipt of any additional graphics-related data. And then the step of writing the additional frame to the plurality of graphics request buffers 22,24,26 or 42,44,46 is writing the additional frame to the memory location in the plurality of request buffers referenced by the second pointer.

The step of comparing the model data from the additional frame with the flushed model data from the stored frame can be an incremental comparison, i.e. ceasing the comparison upon locating a substantial non-matching data set within the model data from the additional frame. Thus, the entire model data frame would not require comparison in order to begin writing the new model data.

Further, the step of flushing the stored frame from the plurality of graphics buffers for processing is preferably flushing the stored frame from the plurality of graphics request buffers 22,24,26 or 42,44,46 to the graphics CPU 20. Otherwise, the flushing of the graphics related data from the request buffers 22,24,26 or 42,44,46 can be to the system bus 18 for processing by the host CPU 14 or another processor accessible from the system bus 18, to include a hardware embodiment of a comparison engine.

The preferred detection method to determine redundant data in the graphics related data is a comparison of the overall frame size. If the frame size in number of bytes is constant between frames, then it is possible that the data is the same and frame need not be written to the buffers. Even if the frame size is constant, a further comparison step should be made to verify the redundancy, such as a byte-by-byte comparison between the frames. Other methods to compare the graphics related data as would be known in the art can alternately be used in the present method, such as flags, dirty bits, and CRC.

The present invention thus prevents the request buffers 22,24,26 or 42,44,46 from handling the redundant model data as the redundant data is not held in the request buffer data queue for the graphics CPU 20. This greatly increases graphics data throughput because writes of data do not occur, and "dirty" cache data does not have to be flushed back to system memory for additional processing. Additionally, the present inventive caching method can be selectively implemented in the request buffers and can be application dependent, being utilized only in applications where significant amount of redundant data is likely to be encountered.

The present caching methodology provides information about the data that can be used for further data optimization. Because the caching method identifies graphics-related data that has been determined to be static, additional analysis and processing of the graphics related data can reveal optimal request buffer data processing at a given instance. For example, very common data elements can be losslessly reduced, or common data elements can be loaded directly into the graphics CPU 20 memory cache to achieve even higher performance.

While there has been shown a preferred embodiment of the present invention, it is to be understood that certain changes may be made in the forms and arrangement of the elements and steps of the method without departing from the underlying spirit and scope of the invention as is set forth in the claims.

What is claimed is:

1. A method for caching graphics-related data in one or more graphics request buffers, comprising the steps of:

initializing a flush start pointer in at least one graphics requests buffer prior to the receipt of any graphics-related data;

receiving graphics-related data at the at least one graphics request buffer;

repositioning the flush start pointer to the beginning memory location where additional graphics-related data will be written;

receiving additional graphics-related data;

flushing the stored data from the at least one graphics request buffer;

comparing the additional graphics-related data with the stored graphics related data;

if the data does not match the stored graphics-related data, writing the non-matched graphics-related data to the at least one graphics request buffers;

otherwise if the data matches the stored graphics-related data, skipping the redundant writes of the graphics-related data; and if non-matched data has been written to the at least one graphics request buffer, incrementing the flush start pointer to the new memory location where additional graphics-related data will be written.

2. The method of claim 1, wherein the graphics-related data includes model data.

3. The method of claim 1, wherein the step of receiving graphics-related data when at least one graphics request buffer is receiving a frame of graphics-related data.

4. The method of claim 3, wherein the step of comparing the additional graphics-related data with the stored graphics related data is comparing the additional frame size with the stored frame size.

5. The method of claim 1, wherein the step of flushing the stored data from at least one graphics request buffer if the additional graphics-related data does not match the stored graphics-related data, is flushing the stored data from the at least one graphics request buffer to the graphics CPU.

6. A method for caching graphics-related data in a plurality of graphics request buffers, comprising the steps of:

initializing a flush start pointer in one of the plurality of graphics requests buffers prior to the receipt of any graphics-related data;

receiving a frame of graphics-related data at the one of the plurality of graphics request buffers, the frame comprised of setup data and model data and the frame being held within the plurality of graphics request buffers;

repositioning the flush start pointer to the beginning memory location in the plurality of graphics request buffers where an additional received frame will be written;

receiving an additional frame of graphics-related data;

determining if model data is present in the additional frame with the stored graphics related data;

if model data is present in the additional frame, flushing the stored frame from the plurality of graphics request buffers for processing;

if model data is not present in the additional frame, writing the additional frame to the plurality of graphics request buffers;

if the model data was flushed from the plurality of graphics request buffers, comparing the model data from the additional frame with the flushed model data from the stored frame;

if the model data from the additional frame does not match the flushed model data, writing the additional frame to the plurality of graphics request buffers;

otherwise, if the model data from the additional frame matches the flushed model data, receiving, but not writing, the entire frame; and incrementing the flush start pointer to the new memory location where an additional frame will be written if received containing new model data.

7. The method of claim 6, further comprising the steps of:

after writing the frame to the memory location, referencing a second pointer to a memory location in one of the plurality of graphics requests buffers prior to the receipt of any additional graphics-related data; and wherein the step of writing the additional frame to the plurality of graphics request buffers is writing the additional frame to the memory location in the plurality of request buffers referenced by the second pointer.

8. The method of claim 6, wherein the step of comparing the model data from the additional frame with the flushed model data from the stored frame is comparing the model data from the additional frame with the flushed model data from the stored frame and ceasing the comparison upon locating a substantial non-matching data set within the model data from the additional frame.

9. The method of claim 8, wherein the step of determining if model data is present in the additional frame with the stored graphics related data is determining if the size of the additional frame is the same as the size of the stored frame.

10. The method of claim 6, wherein the step of flushing the stored frame from the plurality of graphics buffers for processing is flushing the stored frame from the plurality of graphics request buffers to the graphics CPU.

11. A method for caching graphics-related data in one or more graphics request buffers, comprising the steps of:

a pointer initialization step for initializing a flush start pointer to the beginning memory location where graphics-related data will be written in at least one graphics requests buffer prior to the receipt of any graphics-related data;

a first data receiving step for receiving graphics-related data at the at least one graphics request buffer;

a first data writing step for writing the graphics-related data to the memory location referenced by the flush start pointer;

a first pointer incrementing step for incrementing the flush start pointer to the end of the stored data;

a second data receiving step for receiving additional graphics-related data;

a data flushing step for flushing the stored data from the at least one graphics request buffer;

a comparison step for comparing the additional graphics-related data with the flushed stored graphics related data;

if the data does not match the stored graphics-related data, a second writing step of the additional graphics related data to the at least one request buffer;

otherwise, if the data matches the stored graphics-related data, an idling step for skipping the redundant writes of graphics-related data; and if data has been written to the at least one request buffer, a second pointer incrementing step for incrementing the flush start pointer to the new memory location where additional graphics-related data will be written.

12. The method of claim 11, wherein the first data receiving step is receiving model data within the graphics-related data.

13. The method of claim 11, wherein the first data receiving step is receiving a frame of graphics-related data for at least one graphics request buffer.

14. The method of claim 13, wherein the comparison step is comparing the additional frame size with the stored frame size.

15. The method of claim 11, wherein the data flushing step is flushing the stored data from at least one graphics request buffer into system memory of a graphics CPU.

* * * * *